US006206468B1

(12) United States Patent
Brosnan et al.

(10) Patent No.: US 6,206,468 B1
(45) Date of Patent: Mar. 27, 2001

(54) REMOVABLE PADDED SEAT COVER

(75) Inventors: Judith J. Brosnan, Chicago; Scott T. Haugh, Lockport, both of IL (US)

(73) Assignee: Chuen J. Rhee, Chicago, IL (US)

( * ) Notice: Subject to any disclaimer, the term of this patent is extended or adjusted under 35 U.S.C. 154(b) by 0 days.

(21) Appl. No.: 09/241,940

(22) Filed: Feb. 2, 1999

(51) Int. Cl.[7] ..... A47C 31/00
(52) U.S. Cl. ..... 297/228.1; 297/219.1
(58) Field of Search ..... 297/228.1, 228.11, 297/229, 219.1

(56) References Cited

U.S. PATENT DOCUMENTS 3,298,047 * 1/1967 Feinerman ..... 297/228.1 X
3,333,630 * 8/1967 Dudley ..... 297/228.11
3,371,957 * 3/1968 Cook ..... 297/228.1 X
3,804,457 * 4/1974 Hellman ..... 297/219.1
4,260,660 * 4/1981 McCarter ..... 428/284
4,958,886 * 9/1990 Barattini et al. ..... 297/229
5,125,121 * 6/1992 Wroble ..... 297/219.1 X
5,234,252 * 8/1993 Wallach ..... 297/228.1 X
5,265,933 * 11/1993 Croshaw ..... 297/228.1
5,487,587 * 1/1996 Hylton ..... 297/219.1
5,709,431 * 1/1998 Horn ..... 297/228.1

* cited by examiner

*Primary Examiner*—Peter M. Cuomo
*Assistant Examiner*—Stephen Vu
(74) *Attorney, Agent, or Firm*—Laff, Whitesel & Saret, Ltd.

(57) ABSTRACT

A chair cover is provided including a back portion and a base portion. The back portion forms a first pocket having front and rear sides and which is configured to receive the back of a chair wherein the chair back is formed having a plurality of supports. The base portion forms a second pocket that communicates with the first pocket. The second pocket is configured to receive the seat of the chair. An elastic is opening is provided to the second pocket and is located in approximately the center of the base. A fastener associated with said first pocket is provided for attaching the front and rear sides of said first pocket between the supports of the said chair back.

8 Claims, 2 Drawing Sheets

REMOVABLE PADDED SEAT COVER

FIELD OF THE INVENTION

The present invention relates to seat covers which may be placed over chairs. More particularly, the present invention relates to padded seat covers which may be removably installed over un-upholstered dinning room or kitchen chairs to provide additional comfort and a decorative appearance.

SUMMARY OF THE INVENTION

A removable padded seat cover is provided for use with a non-upholstered chair such as a kitchen or dining room chair. The seat cover includes a seat portion which is formed of padded fill material enclosed in an outer fabric cover. The fabric cover comprises a top sheet and a bottom sheet. The top sheet extends over the entirety of the upper side of the seat portion and is sewn to the seat portion fill material in a continuous seam around the perimeter thereof. The upper sheet may also be sewn to the seat portion fill material with a plurality of internal seams to provide the upper surface of the seat portion with a tufted, cushioned appearance. The bottom sheet of the fabric cover, on the other hand, is sewn to the seat portion fill material only along the front and lateral sides thereof. An elasticized opening is formed in the center of the bottom sheet such that an annular pocket is formed around the opening between the bottom sheet and the seat portion fill material.

A back portion is attached to the back of the seat portion, extending upward therefrom. The back portion includes front and back layers of padded fill material. The two layers are bonded together along their top and side edges forming a second pocket which opens at the bottom and is configured to receive the back of a chair. Front and back fabric panels cover the front and backsides of the back portion. The front layer of fill material and front fabric panel of the back portion are joined to the seat portion fill material and the top fabric sheet of the seat portion, and the rear fabric panel and rear layer of fill material of the back portion are sewn to the back edge of the bottom fabric sheet comprising the seat portion. Thus, the opening to the second pocket formed at the lower side of the back portion opens into the rear of the annular pocket formed in the lower side of the seat portion.

To place the seat cover over a chair the chair back is first inserted into the second pocket by pulling the back portion of the cover over the chair back. Once the chair back is fully inserted into the second pocket, the elastic opening to the first pocket can then be stretched over the seat portion of the chair such that the under side of the seat portion fill material rests atop the seat of the chair. Once pulled over the chair seat, the elastic opening can be released, pulling the opening to the annular pocket taut below the seat of the chair.

DETAILED DESCRIPTION OF THE PREFERRED EMBODIMENTS

Figure 2:
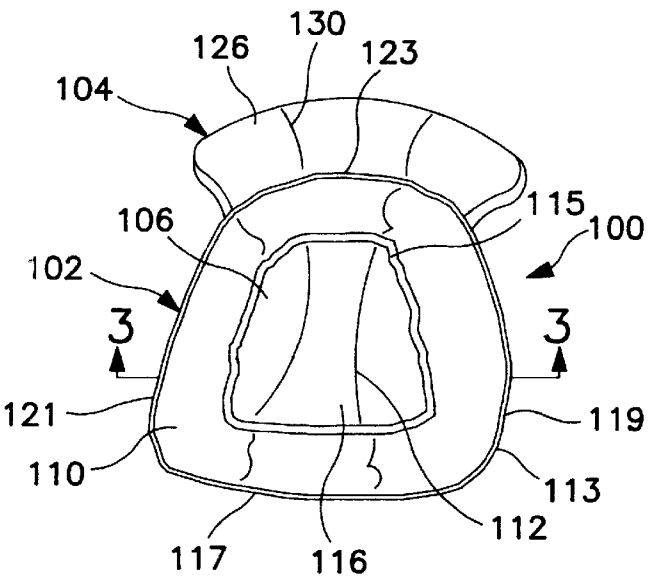
FIG. 2 is a bottom view of the removable seat cover of FIG. 1.

Referring to FIGS. 1–4 a removable seat cover according to the present invention is shown at 100. Seat cover 100 includes generally, a seat portion 102 and a back portion 104. Both seat 102 and back 104 are formed generally of a synthetic fill material covered by a cloth fabric.

Seat portion 102 includes fill material 106, upper fabric cover 108, and lower fabric cover 110. In the preferred embodiment, fill material 106 comprises bonded polyester fibers, and the fabric covers comprise a blend of 80% polyester fibers and 20% cotton. Seams 112 are formed in a plurality of locations through upper fabric cover 108 and fill material 106 to affix the upper fabric cover to the fill material and provide a padded tufted appearance to the seat portion 102. The peripheral edges of upper fabric cover 108 are sewn to fill material 106 at seam 113 which extends around the outer perimeter of seat portion 102. Similarly, the front 117, left 119, and right 121 peripheral edges of the bottom fabric cover 110 (as viewed in FIG. 2) are also sewn to fill material 106 at seam 113. The rear peripheral edge 123 of bottom fabric cover 110, however, is not sewn to fill material 106, but rather is left open for connection to back portion 104 as will be described later. Further, the bottom fabric cover 110 is not included in tufting seams 112, but rather is stretched across the bottom of seat portion 102 and gathered toward the center thereof to form an opening 116. The inside edge of the bottom fabric cover 110 surrounding opening 116 is folded over upon itself and sewn to form a casing 115 around opening 116. An elastic band 114 is inserted into the casing and sewn into a loop or partial loop, which stretches lower fabric cover 110 taut across the bottom of fill material 106. Thus, lower fabric cover 110 forms an annular pocket 118 around the lower periphery of seat portion 102 and the elasticized casing 115 forms an expandable opening 116 thereto.

Figure 1:
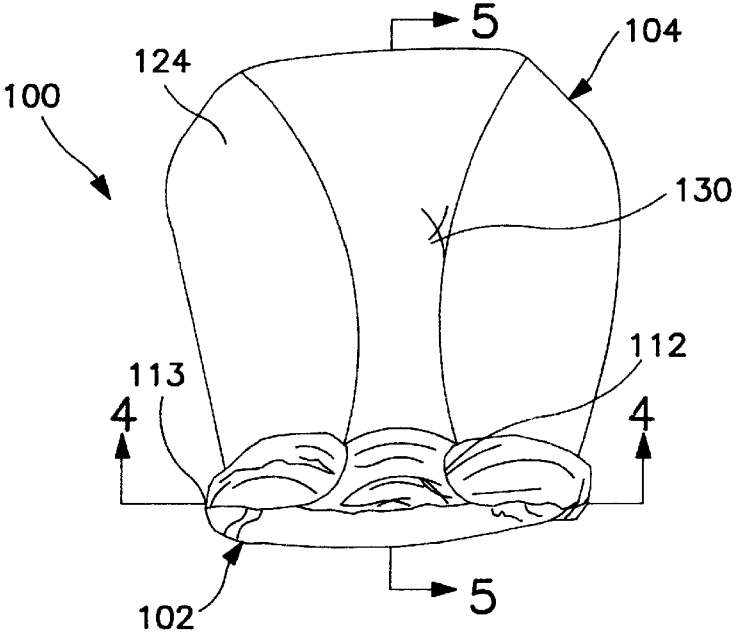
FIG. 1 is a front view of a removable seat cover according to the present invention.
Figure 3:
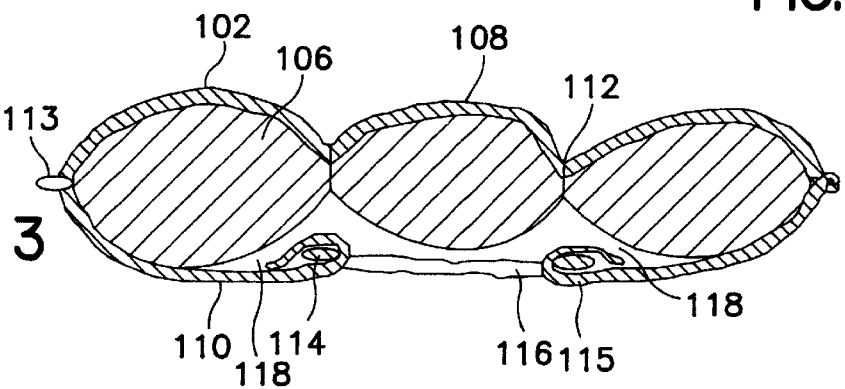
FIG. 3 is a cross section of the removable seat cover of FIGS. 1 and 2 taken along line 3—3.
Figure 4:
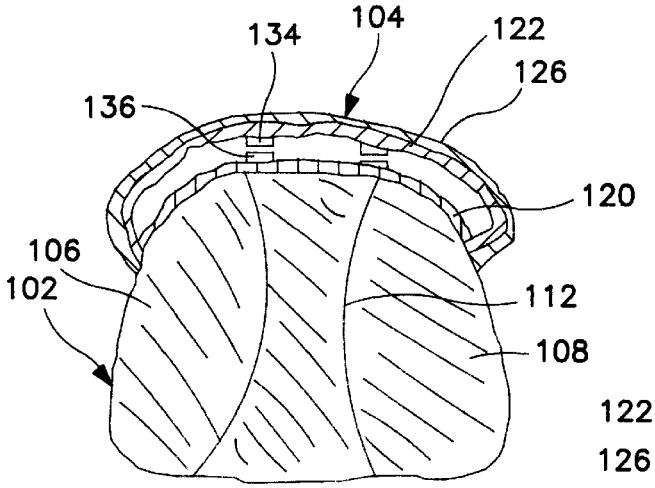
FIG. 4 is a cross section of the removable seat cover of FIGS. 1 and 2 taken along the line 4—4.
Figure 5:
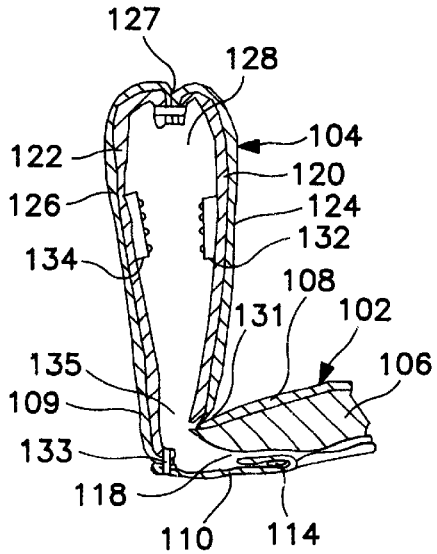
FIG. 5 is a cross section of the removable seat cover of FIGS. 1 and 2 taken along the line 5—5.

With reference now to FIGS. 1, 4 and 5, back portion 104 is formed of front and rear layers of fill material 120, 122 and front and rear fabric panels 124, 126 attached thereto. As with seat portion 102, in the preferred embodiment front and rear fill layers 120, 122 comprise bonded polyester fibers, and front and rear fabric panels 124, 126 comprise a blend of 80% polyester fibers and 20% cotton fabric. The front and rear panels 124, 126 and the front and rear fill layers 120, 122 are all sewn together to form a continuous seam 127 around a substantial portion of the outer perimeter of the back portion 104. Additional seams 130 may be formed in a plurality of locations through front fabric panel 124 and the front fill layer 120 as well as through the rear fabric panel 126 and rear fill layer 122 to provide both the front and rear sides of back portion 104 a padded tufted appearance.

Because front and rear fill layers 120, 122 are only joined at perimeter seam 127, a second pocket 128 is formed between the two fill layers. Fasteners 132, 134 may be affixed to the inside surfaces of front and rear fill layers 120, 122 which form the interior pocket 128 such that the front and rear fill layers may be releasably joined to one another. In the preferred embodiment of the invention, fasteners 132, 134 comprise a hook and loop type fastening mechanism such as Velcro. However, any other type fastener such as buttons, snaps, ties, strings, or ribbons for example, may be employed to equal effect.

Front fill layer 120 and front fabric panel 124 are attached to seat portion 102 at seam 131 which extends along the back of seat portion 102. Similarly, rear fill layer 122 and rear fabric panel 126 are sewn to lower fabric cover 110 to form a continuous seam 133 between the rear side of back portion 104 and the lower fabric cover 110. As best seen in FIG. 5, this arrangement creates an opening 135 to second pocket 128 which communicates with first pocket 118 along the back of seat portion 102.

To install seat cover 100 over a chair, the elasticized opening 116 is stretched over the back of the chair to allow access to second pocket 128. The back portion 104 of the cover 100 is then pulled down over the chair back such that the chair back is fully inserted into the second pocket 128. The elastic opening 116 is then stretched over the seat of the chair such that the under side of seat portion 102 rests atop the chair's seat. The elastic casing is released below the chair seat whereupon the elastic contracts, pulling the lower fabric cover 110 taught below the chair seat.

Figure 6:
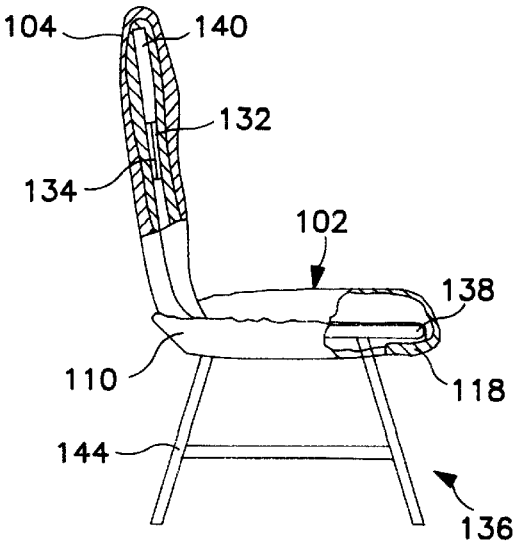
FIG. 6 is a side view and partial cross section of the removable seat cover of FIG. 1 properly installed over a chair.
Figure 7:
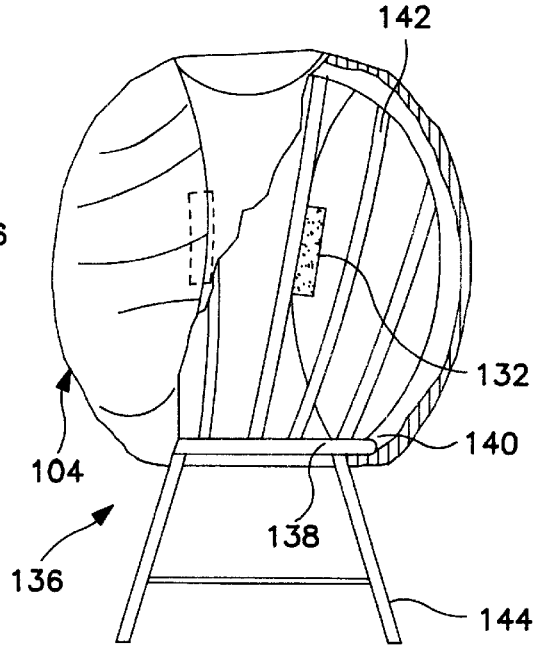
FIG. 7 is a rear view and partial cross section of the removable seat cover of FIG. 1 properly installed over a chair.

The seat cover 100 installed over a typical dinning room or kitchen chair 136 is shown from the side and rear in partial cross section in FIGS. 6 and 7 respectively. Chair 136 includes seat 138, legs 144, back 140, and spindles 142 forming the chair back 140. When properly installed, the chair back 140 supports seat cover back 104, and seat portion fill material 106 rests upon chair seat 138. The chair legs 144 protrude through elasticized opening 116. Fasteners 132, 134 may be joined between spindles 142 to secure seat cover 100 to chair 136.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

The invention claimed is:

1. A removable padded seat cover for use with a non-upholstered chair having a seat back portion including a plurality of spaced apart seat back support members, the padded seat cover comprising:

a seat portion formed of padded fill material and an outer fabric cover, the seat portion having an upper side and a lower side;

an annular first pocket formed in the interior of the lower side of the seat portion between the lower side of the fabric cover and the fill material, an opening to the annular first pocket is formed through the fabric cover and located near the center of said lower side of said seat portion;

a back portion extending upward from a backside of said seat portion, the back portion having front and back sides;

a second pocket formed within said back portion between said front and back sides, said second pocket communicating with said first pocket such that said chair seat back portion may be inserted through said first pocket into said second pocket; and a fastener disposed within said second pocket such that said front side of said pocket may be joined to said back side of said second pocket between said chair back support members.

2. The seat cover of claim 1 wherein the padded fill material comprises bonded polyester fibers.

3. The seat cover of claim 2 wherein the fabric covering the seat and back portions comprises a blend of polyester and cotton fibers.

4. The seat cover of claim 3 further comprising stitching through said fabric covering the upper side of the seat portion and the seat portion fill material creating a tufted appearance to the seat portion.

5. The seat cover of claim 1 wherein the fabric cover extending around a peripheral edge of the lower side of said seat cover portion forms a casing housing an elastic band, thereby creating an expandable opening to said first pocket.

6. The seat cover of claim 1 further comprising stitching through said fabric covering the upper side of the seat portion and the seat portion fill material creating a tufted appearance to the seat portion.

7. The seat cover of claim 1 further comprising stitching through said front fabric panel and said front layer of fill material to provide a decorative tufted appearance to the front of the back portion, and stitching through said rear fabric panel and said rear layer of said fill material to provide a decorative tufted appearance to the rear of the back portion.

8. The seat cover of claim 1 wherein said fastener comprises a hook and loop fastener, wherein one half of the fastener is attached to the front layer of the fill material and the other half attached to the back layer of the fill material.

* * * * *